United States Patent [19]

Yelton et al.

[11] 3,974,534

[45] Aug. 17, 1976

[54] PROCESS FOR VACUUM TREATMENT OF TEXTILE MATERIALS

[75] Inventors: Emerson McBrayer Yelton, Jamestown; James Paul Reid, Jr., Greensboro, both of N.C.

[73] Assignee: Burlington Industries, Inc., Greensboro, N.C.

[22] Filed: Mar. 21, 1975

[21] Appl. No.: 560,883

Related U.S. Application Data

[63] Continuation of Ser. No. 324,673, Jan. 18, 1973, abandoned, which is a continuation of Ser. No. 109,540, Jan. 25, 1971, abandoned.

[52] U.S. Cl. ..... 8/155.1

[51] Int. Cl.[2] ..... D06B 5/18

[58] Field of Search..... 8/149.1, 149.2, 149.3, 8/154, 19, 155.1, 157, 158; 68/5 C, 189, 190; 118/50; 21/65, 66, 67

[56] References Cited

UNITED STATES PATENTS

| | | | |
|---|---|---|---|
| 480,102 | 8/1892 | Keene | 8/157 X |
| 1,986,319 | 1/1935 | Bongrand et al. | 118/50 UX |
| 2,003,409 | 4/1935 | Whitehead | 8/19 |
| 2,169,881 | 8/1939 | Mosher | 8/19 |
| 2,808,715 | 10/1957 | Mellgren | 68/190 |
| 2,936,212 | 5/1960 | Karrer | 8/149.2 X |

*Primary Examiner*—Philip R. Coe
*Attorney, Agent, or Firm*—Cushman, Darby & Cushman

[57] ABSTRACT

A process is provided for batch treatment of textile material such as yarn packages, raw stock, knit goods, muffs or the like by placing the material in an enclosed zone, evacuating the enclosed zone to provide a vacuum therein, and then flooding the evacuated zone with a treating agent by placing the evacuated zone into communication with a second zone having the treating agent therein under a positive pressure. A substantial pressure differential exists between the two zones, and the treating agent flows extremely rapidly through the textile material whereby, at the very outset of the treating process, the treating agent is uniformly distributed over the surfaces of the textile material and substantially in its original concentration and condition. The treating agent includes a dyestuff and other agents, such as scouring agents, whereby several treating operations can be performed simultaneously.

28 Claims, 3 Drawing Figures

Figures 1, 3:
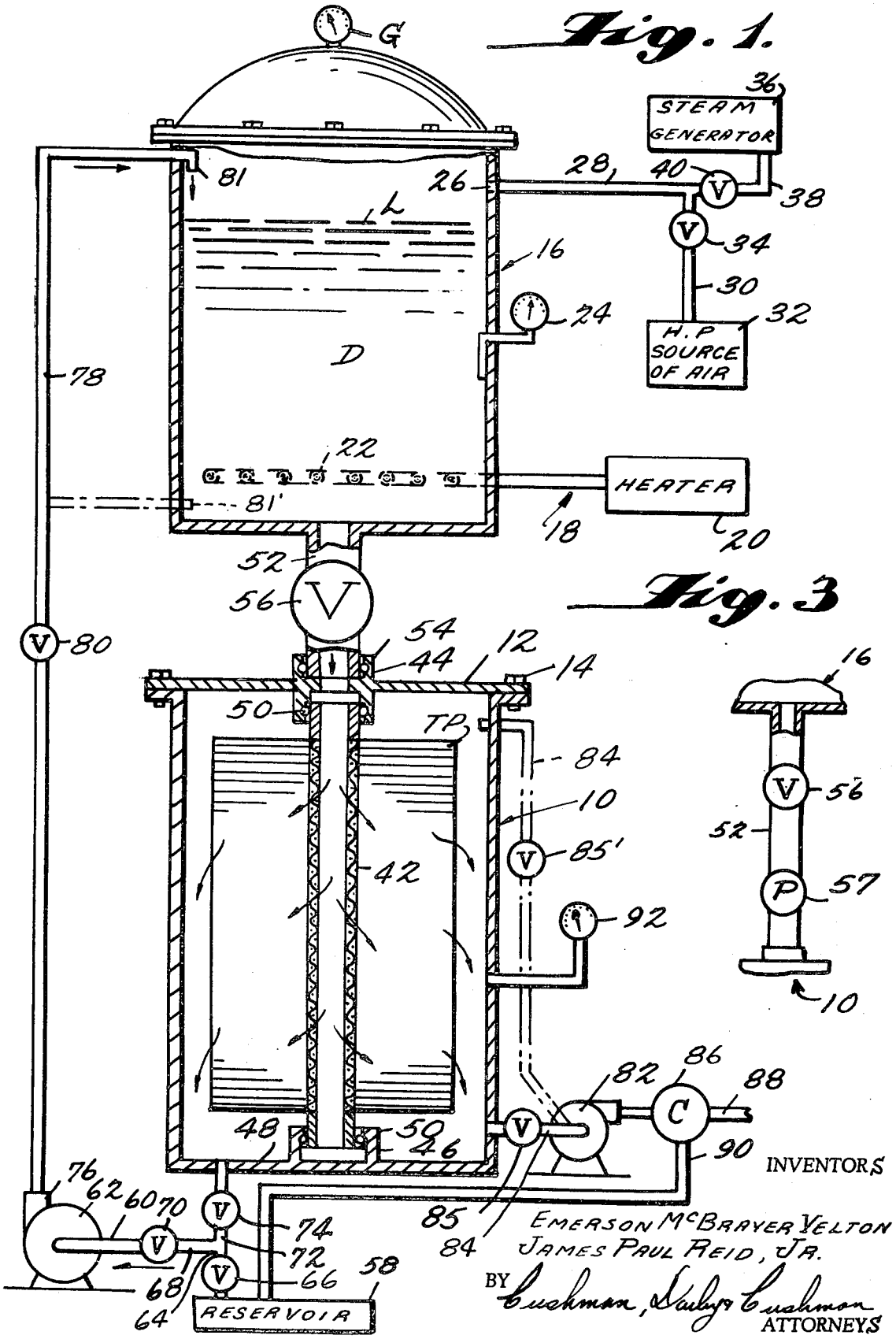

STEAM GENERATOR
H.P SOURCE OF AIR
HEATER
RESERVOIR
G
D
L
TP
INVENTORS
EMERSON McBRAYER VELTON
JAMES PAUL REID, JR.
BY Cushman, Darby & Cushman
ATTORNEYS INVENTORS
EMERSON McBRAYER YELTON
JAMES PAUL REID, JR.
BY Cushman, Darby & Cushman
ATTORNEYS

PROCESS FOR VACUUM TREATMENT OF TEXTILE MATERIALS

This is a continuation of application Ser. No. 324,673 filed Jan. 18, 1973, now abandoned, which in turn was a continuation of application Ser. No. 109,540 filed Jan. 25, 1971, now abandoned.

The present invention is concerned with improved process techniques for batch treatment of textile materials such as yarn packages, raw stock, fabrics, or other forms of textile materials in an appropriate sequence of vacuum conditions and with pressurized fluid treating agents including a combination of a dyestuff with other agents, such as scouring agents.

While the invention is capable of use in the batch treatment of various types of textile materials, it will be illustrated and discussed with particular reference to the dyeing of yarn packages and related processing.

In forming yarn packages in the textile industry, yarn is commonly uniformly wound on perforated spools, tubes or springs or it is commonly wound to form a package on appropriate textile winding equipment, the package being removed from that equipment so as to have an open bore therethrough.

A serious problem encountered in connection with conventional processes for dyeing such yarn packages is that of exhaustion. An important example of this problem relates to the early stages of dyeing, and in conventional processes, the layer of yarn first contacted by the dye will be most heavily dyed, and the liquor will become progressively less concentrated as it moves through subsequent layers of yarn, yielding or tending to yield uneven or poor levelness in the dyed yarn. The amount of dye adsorbed in the first few seconds of dyeing — known technically as the "strike" of the dye — has been recognized to be of the utmost importance.

In the application of Frederick C. Wedler, Ser. No. 746,973, filed July 23, 1968, copending with the parent application hereof, now abandoned, the importance of these first few seconds of the dyeing process is recognized. The invention disclosed in that application and in the continuation-in-part application thereof, now U.S. Pat. No. 3,775,055 filed of even date with the grandparent of this application, now abandoned, provides a novel method and apparatus whereby dye solution is uniformly distributed substantially instantaneously over the surfaces of the textile material to be dyed, and at the very outset of the dyeing process. It will be appreciated that the broad concept of that invention may be applied with great advantage to fluid treating processes, other than dyeing, for textile materials, although it has been found to produce outstanding, unexpected and superior results in dyeing processes. Not only does it yield a final product with desirable color uniformity throughout, but it significantly shortens processing times.

Broadly stated, the process of the Wedler applications, referred to above, involves placing the textile material, for example, the yarn package or packages, in an enclosed zone, the zone then being evacuated so as to place the package under a predetermined and substantial vacuum. By subjecting the package to be treated to a high vacuum or high negative pressure in an enclosed zone, the package is desirably degassed so that as much air, vapor and gasses as is practicable are removed from the yarn prior to processing. A second zone having the treating agent therein may be suitably heated to a predetermined temperature as determined by the process. The second zone is under a higher pressure than exists in the vacuum zone, for example, a positive superatmospheric pressure.

The two zones are then suddenly placed in communication, and due to the great pressure differential between the two zones and the conduit and valve means used, the treating agent from the second zone flows extremely rapidly into the low pressure zone, flowing through the package or packages, in exemplary embodiments, from the interior to the exterior thereof. This extremely rapid flow results in the surfaces of the textile material being exposed to the treating agent substantially instantaneously, or within a few seconds. Thus, the concentration and condition of the treating agent is substantially the same during its passage through the entire yarn package as it is at the very outset of the treating process.

The application of the broad concept of that process to different types of processing operations, for example dyeing, for different types of textile materials has led to the present improvements, as will become evident.

Foreign materials on the surface of or within the yarns or fabrics presented for dyeing have always been a problem due to their tendency to cause uneven application of the dye resulting in poor levelness of the dyed yarn. These foreign materials are normally spin finish, dirt picked up during prior processing, spinning lubricants, coning oils, natural waxes, sizings, and natural contaminants which are particularly present on cotton and wool. Good dyeing practice has always dictated the removal of these foreign substances by a pre-scour by scouring chemicals such as soda ash, other alkaline materials, wetting agents and other scouring assistants. Pre-scour is normally carried out under heat and pressure. The time necessary to raise the temperature to desired levels and carry out the scouring is normally 45–60 minutes. This process has been a slow one because textiles being treated are hydrophobic in nature and tend to resist wetting by water and water-borne chemicals.

Therefore, it has been necessary in the past to use special wetting agents, complexing agents, and other systems, as well as heat and pressure, in order to bring about contaminant removal. Thus, it would not normally occur to one skilled in the art of dyeing to mix the scouring chemicals with the dye bath in order to simultaneously scour and dye in the same bath. However, this idea developed out of observing the pronounced increase in wetting and penetration of yarn brought about by the removal of the occluded air, gasses and vapors due to the vacuum step of the invention disclosed in the aforesaid Wedler applications.

The vacuum removal of occluded air, gasses and vapors has so enhanced the wetting and penetration of yarn, that it has been found possible by the methods set forth hereinbelow to simultaneously scour and dye yarn in the same bath in a number of types of dyeing operations. These types of dyeing include, for example, direct dyeing on cellulosic fibers and yarns, dispersed dyeing of yarns and knitted fabrics, naphthol dyeing of cellulosic fibers and vat dyeing of cellulosic fibers. It has also been found that the separate pre-scour step normally involved in dyeing processes for wool and polyester/wool blended yarns may be eliminated.

Figure 2:
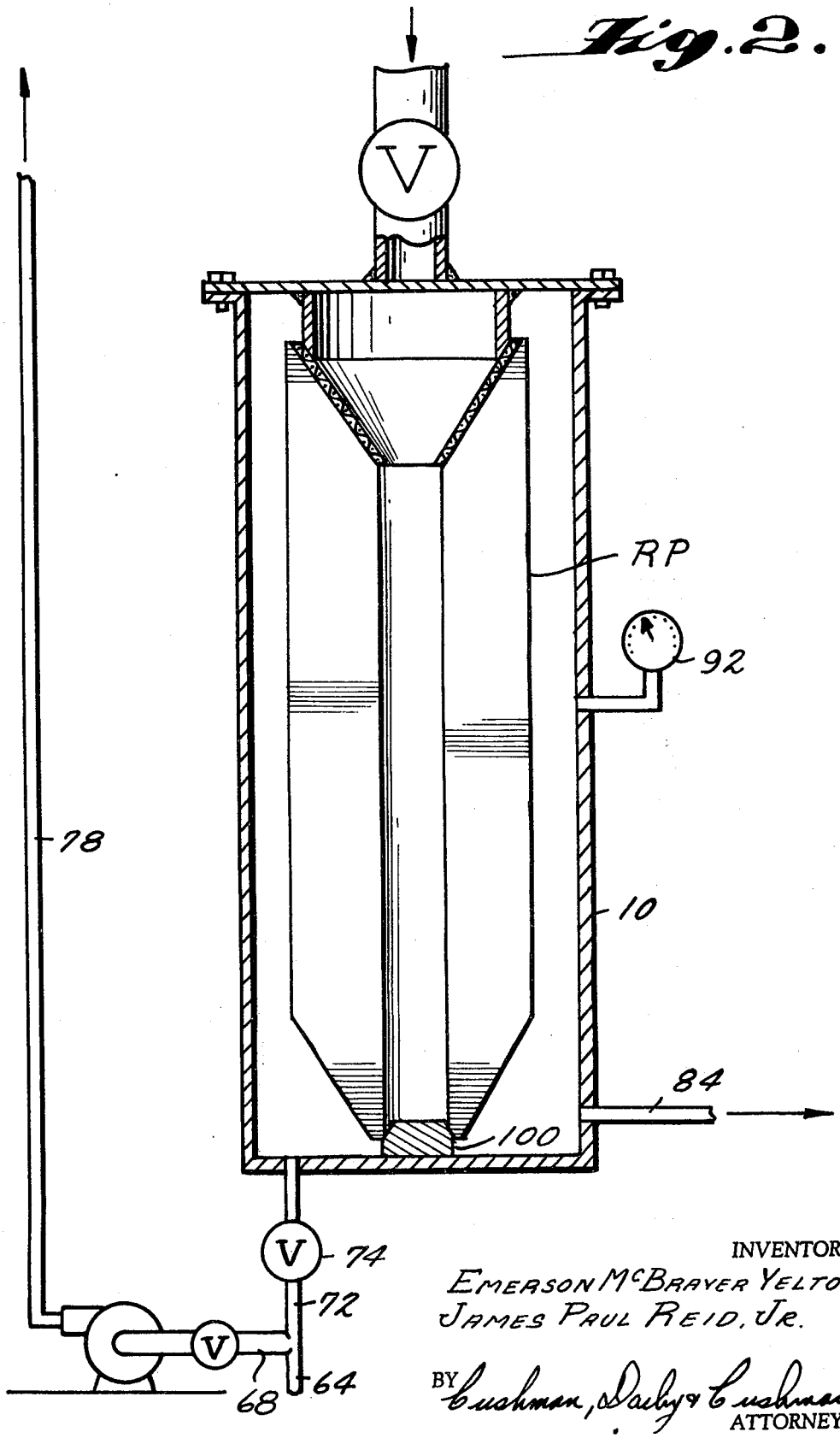

Other objects and advantages of the present invention will become apparent from the following detailed description which refers, in part, to the accompanying drawings wherein:

FIG. 1 is a diagrammatic vertical sectional view of an exemplary apparatus for treating a tube-wound yarn package with a treating agent, according to the invention, FIG. 2 is an enlarged and diagrammatic fragmentary sectional view of the apparatus of FIG. 1 modified for treatment of a rocket-wound package, and FIG. 3 is a fragmentary and reduced, partially sectioned view of a modification of part of the apparatus shown in FIGS. 1 and 2.

Referring to the drawings wherein like character or reference numerals represent like or similar parts, a first tank or kier is generally designated at 10 and serves to define a vacuum or degassing zone. While the tank or chamber 10 is illustrated as supporting a single tube-wound package TP for the purpose of simplicity in this description, it will be appreciated that the tank or kier 10 may be of conventional construction designed to receive a number of packages TP, if so desired, as will be understood. The tank or chamber 10 is made from sufficiently rigid material to be able to withstand a strong vacuum, for example, in the order ot 28 inches of mercury (i.e. 2 inches of mercury absolute pressure) or weaker and/or stronger vacuums. Stainless steel or other suitable material may be used for the tank 10. Tank 10, for the purpose of this description, is provided with a removable cover or lid 12 bolted into position by bolt means 14 when the package TP is positioned therein.

A second tank or chamber generally designated at 16, which defines a second zone for treating agent D, for example dye liquor, scouring liquids, fixing agents, solvents, finishes, or the like, is positioned preferably above the tank 10 although it may be positioned beside or below tank 10. The tank or chamber 16 must be of sufficient volume to carry a supply of treating agent D capable of flooding any size of tank 10 utilized in the system. It will be appreciated that the size of tank 10 is dependent upon the number and types of yarn packages TP to be treated. Tank or chamber 16, like tank 10, is made of a rigid material such as stainless steel or other suitable materials, capable of withstanding pressures in the order of 50–100 p.s.i. or greater. (As used herein, "p.s.i." or "pounds per square inch" will mean gauge pressure, unless otherwise indicated.)

Heating means 18 including, for example, a steam generator 20 and closed steam coils 22 positioned within the tank 16 and immediately above the bottom thereof is provided for heating the treating agent D within the tank to a predetermined desired temperature, the steam generator being capable of raising the temperature of the treating agent to 300°F, if desired. A temperature gauge 24 is provided on the tank 16 for measuring the temperature of the treating agent D therein.

The tank 16 is provided with an inlet 26 for a conduit 28, the inlet being utilized either to apply pressure and/or temperature to tank 16 or to apply steam to the interior of the tank. A branch conduit 30 leading to a high pressure source of air 32, such as an air compressor or the like, communicates with the conduit 28 by a selectively operable valve means 34. A pressure gage G mounted on the dome of the tank 16 provides visual indication of pressure buildup in the tank 16. A steam generator 36 also communicates with the conduit 28 by means of a branch conduit 38 having a selectively operable valve means 40 therein.

Referring back to the tank or kier 10, it will be noted that the yarn package TP is a tube-wound package in which the center portion of the tube supporting the windings of yarn is perforated as indicated at 42. In some instances, the tube for the package is merely a rigid tube with holes whereas it could also be either a spring tube or a screen tube — the latter being illustrated in FIG. 1 — through which a liquid or vapor can easily pass. The ends of the tube of the package TP are shown as fitting respectively into an open collar 44 in the cover 12 and a closed end collar 46 provided on the bottom 48 of the tank 10. Any suitable sealing means 50 may be provided between the respective collars and the tube ends.

A relatively large diameter transfer conduit 52 is shown as being provided between the bottom of the tank 16 and the top of the tank 10, there also being provided sealing means 54 between the conduit and the collar 44. The conduit 52 is provided with a quick-opening large volume selectively operable valve means 56 so that the two tanks 10 and 16 may be quickly placed into and out of communication with each other.

A source of supply or reservoir for treating agent D is generally indicated at 58, the source of supply being in communication with an inlet 60 of a conventional high capacity, reversible pump 62. In more detail, a conduit 64 having a selectively operable valve means 66 therein communicates with a conduit 68 also having a selectively operable valve means 70 therein. The conduit 68 also communicates with the bottom of the tank 10 by means of an outlet conduit 72 having a selectively operable valve means 74 therein.

Since the conduit 52 communicates with the interior of the tube 42, the flow of the treating agent D is from the interior to the exterior of the package, as will be evident.

An outlet 76 for pump 62 communicates with the tank 16 by means of a conduit 78, the conduit 78 having selectively operable valve means 80 therein, and an outlet 81 open to the interior of tank 16. Outlet 81 is shown disposed adjacent the top of the tank 16 but its position therein may be varied, as desired. For example, it may be arranged near the bottom of tank 16, below the liquid level, as indicated in phantom lines in FIG. 1, or it may be disposed at some intermediate point, as will be understood.

In order to evacuate the tank or chamber 10, a high capacity vacuum pump 82 is provided and connected to the tnak by means of a conduit 84 having a valve 85 therein, as shown. Conduit 84 may enter tank 10 adjacent the bottom thereof, as shown in solid lines, or adjacent the top, as indicated in phantom lines, with primed reference numerals. The vacuum pump 82 withdraws the atmosphere from within the tank 10 and at the same time this atmosphere may include some of the treating agent which is or has vaporized. The vacuum pump discharges the atmosphere through a condenser 86 which will discharge gases to atmosphere through a conduit 88 with the treating agent vapors being condensed to liquid and passing through the conduit 90 to the reservoir or source of supply 58. A vacuum gauge 92 provided on tank 10 gives a visual indication of the amount of vacuum within the tank.

Referring now to FIG. 2, a tank 10′ is disclosed for receiving a rocket-wound package RP. In this embodiment the tank 10′ is modified to provide a stub shaft 100 for reception of the bore at the nose of the rocket package RP whereas an enlarged collar 102 is provided for reception of the tail cone 104 of the package RP. The tail cone 104 preferably is perforated or made from a screen material, as shown, so that liquid or vapor can flow easily therethrough.

As hereinbefore mentioned, the systems disclosed in FIGS. 1 or 2 may be utilized in the batch treatment of textile material or the like with various treating agents.

The present invention has been found to yield especially good and unexpected results in connection with textile dyeing operations. The invention makes it possible to improve many known forms of dyeing. Controlling characteristics or parameters responsible for the success of this invention in dyeing operations include the following: providing for extremely rapid flow of the treating agent through the textile material, at the very outset of the treating process, whereby treating agent is uniformly distributed substantially in its original concentration and condition over the surfaces of the textile material to be treated; removal by a strong vacuum (for example, 26–28 inches of mercury, i.e. 2–4 inches of mercury absolute pressure) in kier 10 of as much air, gasses and vapors from the yarn prior to dyeing as is practical; heating the dye bath to the highest practical temperature before adding to the dye kier; pressurizing the dye liquor in tank 16, prior to adding to the kier, with a positive pressure of from 0–100 p.s.i. and preferably 50–75 p.s.i.; utilizing the high pressure differential between kier 10 and tank 16 to force the dye into and through the evacuated yarn; and combining other agents, such as scouring agents, with a dyestuff in the treating agent whereby several treating operations can be performed simultaneously.

The system is also designed to minimize friction losses in transfer of the treating agent by utilizing, as much as possible, large diameter conduits, a minimum number of bends and restrictions, and proper sizing of pump means and valve means, utilizing all desirable engineering practices, as will be appreciated. Operation of the system may be improved by maintaining the positive pressure in tank 16 and the vacuum in kier 10 during the transfer step. And FIG. 3 shows an alternative arrangement wherein a pump 57 is arranged in line 52 between valve 56 and vacuum tank or kier 10, to assist in maintaining desired pressure on the liquor flowing from tank 16 to kier 10.

In the description of the exemplary dyeing operations to follow, it will be understood that the yarn package (or packages) will be first placed into the tank 10 as indicated in the drawings. Valve means 56 and the valve means 74 will be closed. The interior of the tank 10 will then be evacuated or degassed by the vacuum pump 82 until a desired vacuum in the order of 26–28 inches of mercury is reached (i.e. 2–4 inches of mercury, absolute pressure). Either simultaneously with the evacuation of the tank or kier 10, or before or after evacuation thereof, the tank 16 is filled with treating agent D to the desired level L by opening the valve means 66, 70 and 80 and starting the pump 62. When the tank 16 has been filled to its desired level L, valve means 66, 70 and 80 are closed and the treating agent is then heated to a predetermined temperature as desired. The treating agent may be fed directly into tank 16 from other supply means in any suitable manner, and it may be preheated before being introduced into tank 16, as desired.

The tank 16 may be pressurized during heating of the liquor or it may be independently pressurized. The amount or degree of pressure utilized in the tank 16 is dependent on the type of treatment and how large a pressure differential is desired between tanks 10 and 16. As indicated above, the pressure in tank 16 could range from 0–100 p.s.i. with 50–75 p.s.i. being the preferred range.

The tank 16 may be pressurized independently by opening the valve means 34, with the valve means 40 being closed, and flowing air into the tank from the source of high pressure air 32 until the desired pressure is indicated on the pressure gauge G.

When the tank 16 has the liquor D at the desired temperature and under the desired pressure, the valve means 34 may be left either open or closed and the quick-opening valve means 56 is opened so that there is extremely rapid flow of the treating agent into the bore of the package and outwardly through the package into the evacuated zone of the tank 10.

Valve 85 in vacuum line 84 will be closed during transfer, as will be evident. If conduit 84′ is used, valve 85′ will be closed at a suitable time. The speed of distribution of the treating agent to the surfaces of the yarn in the package is substantially instantaneous.

It is also contemplated that there be extremely rapid transfer of substantially the entire charge of treating agent in tank 16 to tank 10, through the yarn package, as will be evident from the examples given below.

As previously indicated, a vacuum may be maintained in the kier 10 during the step of transferring the treating agent after valve 56 is opened, by maintaining valve 85′ in vacuum line 84′ open for a suitable time; likewise a positive pressure may be maintained in tank 16 after the valve 56 is opened.

If it is desired to recycle the dye liquor to obtain the desired diffusion of the dye stuffs from the liquid media into the textile material, it is merely necessary to close valve means 56 when all of the liquor D is in the lower tank 10, open the valves 74, 70 and 80, and use pump 62 to pump the liquor back into the upper tank 16. Then the steps of the process are repeated as described above. If it is desired to recirculate the liquor to obtain the desired diffusion of dye stuffs into the textile material, it is merely necessary to allow valve means 56 to remain open, open valves 70, 74 and 80 and use pump 62 to pump the dye liquor from kier 10 through valves 70, 74 and 80 into upper tank 16 thereby allowing the dye liquor to flow continuously through conduit 52, package TP, kier 10, tank 16 and back into kier 10, etc. The direction of flow for recirculation may be reversed by reversing the flow through pump 62 to effect outside-in recirculation flow through the yarn package.

Valve 85 is vacuum line 84 will be closed during recycling or recirculation, as will be evident.

In another example of color fixation procedure, the dye liquor is drained from the lower tank 10 by opening the valves 66 and 74 and when so drained these valves are closed and the valve means 56 is also closed. The tank 10 is then evacuated by operation of the vacuum pump. The upper tank 16 at this time will be empty and with the valve 80 closed and the valve 40 open, steam is supplied to the tank 16 until it reaches a predetermined pressure and temperature. The steam is then passed through the yarn package in the same manner as the dye liquor, i.e., by opening the quick-opening valve means 56. Vacuum pump 82 may be allowed to operate (with valve 85 open) during the steaming operation to facilitate the transfer of the steam atmosphere through package TP, as will be appreciated.

Combining Operations in the Same Dye Bath

The concepts of the invention disclosed in the Wedler applications, referred to above, have been found to make it possible to combine operations, such as scouring and dyeing, in the same dye bath with improved results, as will be indicated in the following sections and examples.

Direct Dyeing of Cellulosic Fibers and Yarns

Conventionally, in direct dyeing of cellulosic fibers and yarns, a pre-scour is used to remove oil, waxes, and other materials that interfere with even penetration of the dye. It was also necessary, by conventional practice, to add the color and the salt to the dye bath separately and in small increments over a period of about 40 minutes, while the temperature of the dye bath was slowly raised.

The vacuum-pressure concepts in the aforesaid Wedler applications were applied to the specific area of direct dyeing of cellulosic fibers. An improvement in wetting and levelness of dyeing has been obtained when air, vapor and other gases were removed from the yarn prior to dyeing simultaneously with the rapid addition of the dye liquor at high temperature under a positive head of pressure. Some of the objectives were:

1. To attempt to reduce the dye cycle time for direct dyeing of cellulosic fibers and yarns.
2. To attempt the combination of the pre-scour with the dyeing operation in one bath.
3. To bring the dye to temperature with the salt present and then initiating dye flow through the package to achieve uniform distribution of the dye solution throughout the entire package, substantially immediately.

Thus, the mixing of dye, salt, and pre-scour chemicals all in one bath and applying this at high temperature, e.g., about 200°F, rapidly to the dry yarn violates principles laid down for obtaining good level dyeing of cellulosic yarns and fiber. Yet, this process of simultaneous scouring and dyeing has been applied to a wide diversity of dyes and cellulosic fibers and yarn types and packages with remarkable success, as illustrated by the following examples.

EXAMPLE NO. 1A

Direct Dyeing in 50 Pound Package Dye Machine 50 pound lot on dye springs.
Yarn-Rayon
Count — 10/1
Color-Blue
Dyestuff-Direct In this example, the expansion tank was filled to the desired level and scour chemicals, dye, salt, and dye additives were added. Thereafter, the mixture was heated to 200°F. The pressure on the expansion tank 16 was 50 pounds per square inch. The kier 10 was evacuated to approximately 26 to 28 inches of mercury. The drain (or valve 56) was opened to the expansion tank and the dye liquor was transferred through the packages from the inside-out with the transfer time for the entire volume of dye liquor being 23 seconds.

It was run for three minutes inside-out and 7 minutes outside-in. The yarn was exposed to the dye for 30 minutes at 200°F (under 10 to 20 p.s.i.) and the dye bath was thereafter drained. The yarn was thereafter rinsed in a normal manner.

Results — Shade — satisfactory; Weight — heavy; Appearance — satisfactory.
Machine Time — 1 hour and 30 minutes.

EXAMPLE NO. 2A

Direct Dyeing in 50 Pound Package Machine

A 51 pound lot on springs
Yarn-Rayon
Count — 10/1
Color—Gold
Dyestuff-Direct. The procedure used in this dyeing was that described under Example No. 1A.
Results — Shade — satisfactory; Weight — satisfactory.
Machine Time - 1 hour and 30 minutes.

EXAMPLE NO. 3A

Direct Dyeing in 50 Pound Package Machine

A 42 pound lot on dye springs
Yarn-Rayon/Cotton
Count — 7/2
Color—Orange
Dyestuff-Direct. This dyeing was also done by the procedure for Example No. 1A.
Results — Shade — satisfactory; Weight — satisfactory; Appearance — satisfactory.
Machine Time — 1 hour.

EXAMPLE NO. 4A

Four Lots were run in a 7 hour period. The procedure described in Example 1A for the 50 pound dye package machine was essentially followed in the production runs except the time for transfer for the entire volume of dye liquor (from tank 16 to kier 10) was now 18 seconds for a volume of 1,100 gallons. First production was run on 1,902 pounds of yarn.

Yarn-K.P. Cotton
Count — 5.5/1
Color — Direct Green
Dyestuff—Direct
Results — Good dyeings were obtained and a savings of approximately 12% dyestuffs was realized.
Machine Time — 1 hour and 20 minutes.
Second Run — 1,972 pounds
Yarn-Rayon/Cotton Slub Yarn
Color—Direct Green
Dyestuff—Direct
Results — Same as first run.
Machine Time — 1 hour and 20 minutes.
Third Run — 1,903 pounds
Yarn-K.P. Cotton Yarn
Count — 5.5/1
Color-Direct Green
Dyestuff-Direct
Results — Same as two previous runs.
Machine Time — 1 hour and 20 minutes.
Fourth Run — 1,976 pounds
Yarn-Rayon/Cotton Slub Yarn
Color-Direct Green
Dyestuff-Direct
Results — Same as three previous runs.
Machine Time — 1 hour and 20 minutes.

The following tables, in parallel, comparing requirements for conventional direct dyeing with direct dyeing of the present process combining the dyeing and scouring operations, show advantages of the novel process disclosed herein.

| Conventional Direct Dyeing | Direct Dyeing of the Present Process |
|---|---|
| 1. Pre-scour - 30 minutes to 45 minutes. | 1. No pre-scour |
| 2. Rinse cycle - 15 minutes | 2. Add scour chemicals, dye, salt, and any other desired chemicals to bath at one time. |
| 3. Salt addition step - very critical over a 40 minute period | 3. No separate controlled salt addition. |
| 4. Total machine time - 3 hours | 4. Time to simultaneously scour, dye, and saltset is one hour and 20 minutes. |
| | 5. Reduction in dye used is 12–15%; better quality product obtained; and substantial savings in water usage. |

The wide range of cellulosic yarns and direct dyestuffs tried has demonstrated that the scope of this invention essentially covers many types of cellulosic yarns and fibers and a wide range of direct dyestuffs. Specific variables are as follows:

The pressure range for transfer of the dye to the dye packages can be 0–100 p.s.i., but the preferred range is 50 to 75 pounds per square inch. The actual dyeing is carried out at a pressure of 0 to 30 p.s.i. with a preferred range of 10 to 20 p.s.i. The dye package is evacuated with the lowest practical pressure obtainable in the dyeing equipment. In practice, this has proved to be about 26 to 28 inches of mercury. Preferred temperature range is 160° to 200°F, although the temperature can go higher, if desired.

Naphthol Dyeing of Cellulosic Fibers and Yarns

The normal naphthol dyeing process has four main steps, namely, pre-scour; naphtholate step; salt rinse; and coupling bath. As is understood, this has been a long and involved process taking, for example, about 7 hours. Any modification of this dyeing method that combines steps and shortens the process in modified existing equipment is of great importance because it increases the capacity of the existing dyehouses to handle more yarn.

Another problem with naphthol dyeing has been that this process involves the reaction of chemicals producing a color change in the coupling step. This reaction has to be very carefully controlled in order to get good uniformity in the shade of the dyed yarn. It also requires that coupling agent penetrate the yarn rapidly and evenly so that the degree of reaction is uniform throughout the yarn package. Shading to produce the desired color is difficult with the developed colors because in many cases the developed color is sufficiently different from the initial color (after the naphtholate step) on the cloth or yarn that a great deal of experience is necessary to be able to obtain the proper shade.

It has been found that the application of vacuum during the coupling step increases the speed of penetration of the solutions into the yarn and brings about uniform and complete reaction of the two dye components. This has resulted in reducing the amount of reworking of dye lots to obtain the proper shade. The novel system and techniques, referred to herein, also appear to reduce the tendency of naphthols to crock.

The examples given below illustrate dyeing of cellulosic yarns with various naphthol dyes.

EXAMPLE NO. 1B

Dyeing of Cellulosic Yarns by Naphthol Dyes in Vacuum Package Dyeing Equipment A 45 pound lost of yarn on dye springs
Yarn — Cotton
Count — 5.5/1
Color — Red
Dyestuff—Naphthol Dye
Dyebath: 1.0% Sycopen
0.5% Chelate
3.0 lb. caustic soda (50% vol.)
8.6% Naphthol ASSW (33% vol.)
0.5% Casoline Oil
2.0% Methanol
0.36% Naphthol ASLB (20% solution)
2 salt rinses (2.5 gal. brine)
Coupling Bath:
3.2% Fast Red PDC Base
0.5% Triton X405
4.0% Muriatic Acid
1.6% Sodium Nitrate
3.2% Sodium Acetate
2.0% Acetic Acid
Scour No. 1: 1.0% Triton X405
Scour No. 2: 1.0% Bi-scour D
1.5% Soda Ash
Softener: 1.5% Scouravel

Dyeing of Cellulosic Fibers or Yarns with Napthol Dyes

1. Fill expansion tank and heat to 140°F.
2. Add caustic soda, while circulating.
3. Add salt while circulating.
4. Cut off pump and add boil-out.
5. Start pump and add naphtholate.
6. Transfer dye to kier and run at 160°F for 20 minutes with transfer time for the entire volume of dye liquor being 23 seconds.
7. Cool to 100°F and run 10 minutes. Drain.
8. Run first salt rinse from big expansion tank with 30 pounds caustic soda (50%).
9. Run second salt rinse by regular production procedure.
10. Vacuum extract twice.
11. Mix base (add ice only in summer) in big expansion tank and transfer to kier and run 30 minutes at 60°–70°F. Drain.

12. Add first scour and run at 130°F for 10 minutes. Drain.
13. Hot wash continuously inside/out until clear.
14. Add second scour and run at 200°F for 10 minutes. Drain.
15. Hot wash continuously inside/out until clear.

Results — The shade was satisfactory. A good level dyeing was obtained throughout the package. A reduction in crocking was noted.

Machine Time — 4½ hours

EXAMPLE No. 2B

Dyeing of Novelty Rayon Yarn by Naphthol Dye in Vacuum Package Dyeing Equipment 20 pound lot novelty yarn on dye tubes
Yarn—Novelty Rayon
Color—C/Red
Dyestuff—Naphthol Dye
Dyebath: 0.5% Chelate No. 1
7.0% Caustic soda (50% vol.)
8.0% Naphthol ASSW (33% vol.)
0.33% Naphthol ASLG powder
0.9% Naphthol ASLB powder
0.5% Caustic soda
4.5% Methanol
0.5% Triton X-405
0.2% gal. salt brine
Coupling:
2.4% Fast Red KB Base
0.5% Triton X-405
2.4% Muriatic acid
1.20% Sodium Acetate
0.96% Sodium nitrate
Scour No. 1: 1.0% Triton X-405
Scour No. 2: 1.0% Soda Ash
1.0% Triton X-45

The same procedure was used in running this dyeing as was used in Example No. 1B above.

Results — Shade was satisfactory. A good level dyeing was obtained throughout the package.

Specific variables of the above process of naphthol dyeing include the following: pressure range for transfer of dye to dye package can be 0–100 p.s.i., but the preferred range is 50 to 75 p.s.i.; the actual dyeing is carried out at pressures of 0 to 30 p.s.i. with a preferred range of 10 to 20 p.s.i.; the dye package is evacuated to the lowest practical pressure obtainable in the dye equipment and, in practice, this proved to be 26 to 28 inches of mercury; and preferred temperature range is 100° to 180°F.

Some advantages realized in the application of the invention to naphthol dyeing are as follows: no prescour is required, scouring chemicals and dye can be added in one bath and both operations can be performed simultaneously; substantial savings in water usage; time for the naphtholate procedure is reduced approximately one-fourth; the uniformity of naphthol dyeings is improved by using vacuum to impregnate the package with coupling salt; and the total time for the naphthol dyeing cycle has been decreased from 7 hours to 4½ hours.

Vat Dyeing of Cellulosic Fibers and Yarns

The principal problems of dyeing cellulosic fibers and yarns by the vat procedure stem from the complex multi-step process required and from the fact that the method had to be varied from one vat color to another. Such changes in the methods or procedures may lead to confusion and error when changing from one vat dyeing to another, as will be appreciated. The use of the method of this invention for adding the dye substantially reduces the time for impregnation of the yarn. The completeness of impregnation has also improved the levelness of dyeing. The experience to date indicates that one dyeing procedure can be applied to many vat colors. This would simplify the training of dyers and would also minimize the danger of poor dyeing results due to choice of the wrong method. The total process time for vat dyeing has been reduced, by this novel method, by about 25%.

The novel methods, referred to herein, of vat dyeing of cellulosic fibers and yarns have been found to permit realization of the following objectives: simplification of the dyeing process; improvement of the evenness of impregnation of the dye package with the dispersed vat dye particles; reduction of the variation of procedure heretofore necessary for virtually each vat dye; and development of a better procedure for union dyeing polyester/cotton blends.

The following examples illustrate application of the invention to the dyeing of cellulosic fibers and yarns, and blends, with vat dyes.

EXAMPLE NO. 1C

Dyeing of Polyester/Rayon Yarn Using Vat Dyes for the Rayon

An 84 pound batch of yarn was dyed:
Fibers — 65/35 Fortrel/Rayon
Color—Gold
Yarn Count — 21/2

Results — Laboratory evaluation of this dyeing was satisfactory and the dyeing was on shade.

Machine Time — Conventional dyeing time — 275 minutes running time. Vacuum Dyeing time — 215 minutes.

Vat Dyeing of Cotton

1. Evacuate kier 10 minutes.
2. Add dye and auxiliaries to expansion tank.
3. Pressurize expansion tank to 40 p.s.i.
4. Transfer dye to kier on inside/out with transfer of total volume of dye liquor from tank 16 to tank 10 taking 18 seconds.
5. Switch to outside/in-run 10 minutes.
6. Add caustic soda — run 5 minutes.
7. Add sodium hydrosulfite — run 20 minutes.
8. Rinse for 20 minutes.
9. Add sodium perborate, heat to 160°F, then add soap and heat to 200°F.
10. Run for 10 minutes.
11. Rinse 20 minutes.
12. Add finish and run 15 minutes.
13. Drain EXAMPLE No. 2C Fortrel/Cotton Dyeing A 84 pound load of the following yarn was vacuum dyed:
Fibers — 50/50 Fortrel/Cotton
Color—Dahlia
Yarn Count — 31/2

Results — Luster of this dyeing was satisfactory and uniform result was noted from the knitted sock. The shade matched the control shade. Four dyeings using two-ply yarn produced excellent uniformity.

Machine Time — Conventional dyeing time - Approximately 300 minutes. Vacuum dyeing time — 210 minutes.

The procedure used for this dyeing was the same as given in Example No. 1C.

EXAMPLE No. 3C

Fortrel/Cotton Dyeing

A 90 pound load of the following yarn was vacuum dyed:

Fibers — 50/50 Fortrel/Cotton

Color-Pink

Yarn Count - 21/1

Results — Luster was satisfactory and levelness and uniformity were good.

Machine Time — 300 minutes, Vacuum dyeing — 215 minutes.

The same procedure was used for this dyeing as was used in Example No. 1C.

EXAMPLE No. 4C

Dyeing Polyester/Cotton Yarn with Problem Vat Colors

Three vat colors which had been problem shades when dyed on 50/50 Fortrel/Cotton by conventional pressure dyeing were successfully dyed according to the present invention. The procedure used was the same as was given in Example No. 1C above, and the yarn count on this blend was 31/1. The colors dyed in successive runs were: Grey; Gold; and Blue. In each case, use of the techniques of the present invention gave excellent level and uniform dyeing, as was shown by examination of the knitted socks and the shade was a good match to the control. The machine time in each of these cases was 215 minutes as opposed to a normal machine time of 275 minutes.

EXAMPLE No. 5C

Dyeing Procedure for Applying Vat Dyestuff to 100% Cotton and Rayon/Cotton Yarn

1. Premix dye with BiChem Dyebath PR-50 and Chelate No. 1.
2. Fill expansion tank to desired level and heat to 140°F – 160°F. Add dye to expansion tank.
3. Pressurize expansion tank to 55 p.s.i. and pull vacuum on kiers.
4. Transfer dyebath to kiers, with transfer time for the entire volume of the dye liquor from tank 16 to tank 10 being 18 seconds. Run 30 seconds inside/-out.
5. Run outside/in for 15 minutes. Release air pressure.
6. Add Basogal P and caustic soda, run 10 minutes.
7. Add sodium hydrosulfite in three parts at 5 minute intervals.
8. Run 30 minutes.
9. Start cold running wash outside/in and cool to 100°F.
10. Switch to inside/out and wash until clear (20–30 minutes).
11. Add sodium perborate or hydrogen peroxide and raise temperature to 200°F.
12. Add scouring chemicals and run 15 minutes.
13. Start hot running wash inside/out and run until clear. Cool to 100°F and drain.

This dyeing was made on 1,130 pounds of cotton,

Fibers — KP Cotton

Color—Vat Orange

Yarn Count —5.51

Results — A uniform and level dyeing was obtained throughout all the packages. The color was on shade with the control.

Machine Time — 215 minutes.

EXAMPLE No. 6C

Vat Dyeing of Rayon/Cotton Slub

The dyeing procedure ws the same as given in Example No. 5C above. The kier was loaded with 1,198 pounds of Rayon/Cotton.

Fibers — Rayon/Cotton Slub

Color-Vat Orange

Results — A level dyeing was obtained with good uniformity throughout the yarn packages. Dyeing was on shade with the control.

Machine Time — Approximately 215 minutes.

Specific variables of the vat dyeing processes are essentially the same as those previously given regarding pressures and temperatures in the tanks 10, 16.

Some of the advantages from application of the novel methods disclosed herein to vat dyeing of cellulosic fibers and yarns are as follows:

1. Makes it possible to dye polyester/cotton yarns and fibers with may different dyes using simplified procedures. In contrast, different vat colors heretofore required variations in the dyeing procedure.
2. In dyeing cotton and cotton/rayon blends, the boil-out chemicals can be added directly to the dye bath.
3. Additions of certain chemicals to the dye bath can be made at the beginning of the dye cycle.
4. The rapid wet-out of the yarn in the present invention makes it possible to add these chemicals in one step.
5. Satisfactory uniformity of distribution of the dye throughout the package is achieved in a simplified procedure.
6. The variation of shade from package to package for those on the top of the dye stand to those at the bottom is virtually eliminated due to the excellent wet-out obtained by the impregnation of the dye packages.

Dyeing of Polyester and Polyester Blends

There has been an increase in the use of polyester fibers none and as blends with natural fibers which has made it desirable to reduce the length of time necessary to dye polyester. This need resulted in application of the invention to polyester dyeing and advantages have been realized by the use of this system rather than the conventional or normal pressure dyeing method, as will become evident. With respect to 100% filament polyester yarn, other objectives, besides reducing the cycle time, were to eliminate any need for pre-autoclaving polyester yarn to heat-set it before dyeing, and to improve the shade uniformity of polyester dyeing.

It will be understood that there are two dyeing procedures for dyeing polyester/cotton blends one to dye the polyester portion and one to dye the cotton. The following examples are concerned only with the dyeing of the polyester portion:

EXAMPLE NO. 1D

Dyeing of Polyester in a Modified 100 Package Dyeing Machine

Yarn—84 lbs. of polyester/cotton
Fibers — 50/50 Fortrel/Cotton
Color—Olive
Yarn Count — 35/1
Procedure used to run polyester part of the yarn as follows:

1. Fill expansion tank at 180°F, add pre-scour chemicals, carrier and other chemicals and dye. Pressurize the expansion tank to 50 p.s.i.
2. Evacuate kier to approximately 26–28 inches mercury.
3. Set controller temperature to 255°F and rate rise to maximum 4°–5°F/minute.
4. Open expansion tank drain and the entire amount of dye liquor was transferred to the vacuum tank in 23 seconds. Run for 3 minutes inside/out, 3 minutes outside/in.
5. When temperature reaches 255°F, run for 30 minutes and drain at 200°F.
6. Wash with hot water until clear.

Results — Luster was satisfactory, uniformity of dyeing was excellent and the woven fabric looked very good.

Machine Time — Standard or conventional (nonvacuum) Dyeing Time — 110 minutes. Vacuum Dyeing — 70 minutes running time.

EXAMPLE No. 2D

Dyeing of Polyester in Modified 100 Package Dyeing Machine

Yarn—Polyester/Rayon
Color—Black
Yarn Count — 14/1
Dye procedure of Example No. 1D was used to dye this yarn as well.

Results — Luster was satisfactory and the uniformity of dyeing was excellent. The lot of yarn was used as filling yarn and woven into fabric. Observations on the inspection table showed that all the vacuum dyed yarn was of first quality and gave a brighter black than the portion of the cuts with regular black yarn.

Machine Time —70 minutes running time vs. 110 minutes running time of the standard or conventional (nonvacuum) dyeing procedure.

EXAMPLE NO. 3D

Package Dyeing of Polyester Tow

A 1-pound lot of polyester tow was dyed according to the invention, using the procedure of Example No. 1D.

Yarn-T-64 Crimped Dacron Polyester tow Color-three dyeings were carried out with the following colors: Rust; Blue and Green.

Dyestuffs—Disperse

Results — Repeatability of dyeing was good, levelness of dyeing was good, and pictures, microphotographs of the textile material showed good penetration with no evidence of ring dyeing.

Machine Time — Regular or conventional (nonvacuum) process — 3½ hours vs. Vacuum-Pressure Method — 1¼ hours to 1½ hours.

EXAMPLE No. 4D

Package Dyeing of Textured Polyester

The procedure of Example No. 1D was used in this example also. Two 1 pound packages of textured polyester yarn were dyed — one was autoclaved and the other was not.

Yarn-Textured Polyester 150/34, T-56
Color — Yellow
Dyestuff-Disperse

Results — Yarn was knitted into sleeves, all of which showed very level dyeing. It was impossible to tell the difference between the autoclaved and nonautoclaved yarn on the basis of this dyeing.

Machine Time — 1¼ hours to 1½hours.

EXAMPLE NO. 5D

Package Dyeing of 100% Textured Polyester Fabric

The dyeing procedure of Example No. 1D was used in this experiment. A sleeve of polyester double knit weighing 390 gms. was put on the dye spindle.

Yarn —100% Textured Polyester
Color — Green.
Results — Good level dyeing was obtained.
Machine Time — 1 hour 20 minutes.

EXAMPLE NO. 6D

Dyeing of Textured Polyester Yarn Packages

This example was carried out according to the procedure of Example No. 1D. Repeat dyeings were made in 1 pound lots on textured polyester yarn — two Rose Quartz, three Regal Purple, and two Expresso.

Yarn-Textured Dacon Polyester T-56
Denier — 150/34
Color-Rose Quartz, Regal Purple, and Expresso
Dyestuff-Disperse Results — There was good uniformity from one dyeing to another of each shade.

Machine Time — 1½hours.

The foregoing examples indicate that the invention can be applied to textured and untextured, spun and filament polyester and polyester tow. Specific variables include: pressure range to transfer the dye to the dye packages is essentially 0 to 100 p.s.i., but the preferred range is 50 to 75 p.s.i.; actual dyeing is carried out at a pressure of 0 to 30 p.s.i. with the preferred range of 10 to 20 p.s.i.; the dye package is evacuated to the lowest practical pressure obtainable in the dye equipment and, in practice, this has proved to be 26 to 28 inches of mercury. Preferred temperature range is 180° to 255°F.

The following parallel tables indicate the advantages of dyeing polyester by the novel methods disclosed herein, as compared to standard or conventional methods:

| Standard Pressure Polyester Dyeing | Vacuum-Pressure Polyester Dyeing |
|---|---|
| 1. Yarn is autoclaved prior to dyeing to heat-set it. | 1. It is not necessary to pre-autoclave the polyester yarn. |
| 2. A pre-scour of about 45 minutes is run. | 2. The pre-scour of the yarn has been eliminated. |

-continued

| Standard Pressure Polyester Dyeing | Vacuum-Pressure Polyester Dyeing |
|---|---|
| 3. The dyeing cycle requires about 3 to 3½ hours. | 3. The dyeing cycle has been reduced from about 3 to 3½ hours to about 1 hour 10 minutes to 1 hour and 30 minutes. Scouring and dyeing are carried out simultaneously in the same bath. |
| 4. Considerable difficulty is encountered in obtaining shade uniformity. | 4. In the normal procedure the dye bath starts out at a low temperature of about 100°F and is raised slowly to an optimum of 230°–255°F in order to get level dyeing. However, it is possible to apply the dye bath at 180°F 190°F to the dry yarn and raise the temperature at a rapid rate to 255°F. |
| | 5. Much better uniformity of shade has been obtained. |

Dyeing Wool

Conventional dyeing of wool yarns and tops made from wool or wool blends has been beset with four primary problems: (1) High temperature used in dyeing these fibers has caused loss of strength and elongation; (2) Pressure buildup due to the slow wetting and penetration into the top and yarn package has caused "blowing" of tops with subsequent necessary reworking and tremendous dollar loss due to felted wool; (3) Poor uniformity of shades within dye package due to uneven striking of the dye into the yarn package; and (4) Felting due to prolonged exposure to circulation of dye liquor. The application of the novel methods disclosed herein to the dyeing of wool and wool blends has been found to eliminate or minimize these problems, and to realize the following objectives: reduction of the time necessary to dye wool and wool/polyester blended yarn; reduction of the time at temperature necessary to obtain good level dyeing of wool and wool blends by taking advantage of the superior wetting and penetration due to the evacuation of air; reduction of wool felting during dyeing; and reduction of the time necessary to dye wool thereby reducing the damage done to the physical properties of wool yarn.

The following examples illustrate application of the novel methods disclosed herein to dyeing wool top, 100% wool and wool/polyester blended yarn.

EXAMPLE NO. 1E

Grey 0.5% Nonionic detergent
0.75% Acetic Acid
0.1% Chelate No. 1
1.0% BiChem Dyebath DA
0.4% Isolan Black GL Vacuum-Pressure Procedure for Wool Top 1. Pull vacuum for 10 minutes on kier.
2. Set temperature control at 190°F for Grey.
3. Fill expansion tank with dyebath including acid and dyestuff auxiliaries at 190°F.
4. Close expansion tank lid and heat to 5 p.s.i. steam. Add air to total 50 p.s.i.
5. Transfer dyebath to the dye kier on an inside/out setting with transfer time being 4 seconds for transferring 7.5 liters from the expansion tank 16 to the vacuum tank 10. Switch to outside/in.
6. Run for 2 minutes inside/out and 3 minutes outside/in.
7. Run for 20 minutes.
8. Cool to 160°F and drain.
9. Cold wash inside/out.

Results — Uniformity of dyeing was good. There was less loss of strength and elongation of the wool fibers.

Machine Time — 45 minutes rather than 200 minutes normal production time.

EXAMPLE NO. 2E

Gold 0.5% Nonionic detergent
1.5% Acetic acid
0.5% Chelate No. 1
1.0% BiChem Dyebath DA
2.65% Isolan Yellow GSA
0.38% Levolan Brown 1BRL The same vacuum dyeing procedure was used as was given in Example No. 1E, except the dyeing temperature was 200°F for the Gold Color.

EXAMPLE NO. 3E

Vacuum Dyeing vs. Regular or Conventional Production Yarn 1/50 Wool — Color Gold Two cones of 1/50 wool yarn were vacuum dyed according to the invention. This data was compared with regular production data from the same color, gold. The procedure used in dyeing these lots was the same as given in Example No. 1E above, except the dyeings were made at two different temperatures, 200°F in one lot and 210°F in the second lot. Dyeing time was 15 minutes on each plus time to prepare for dyeing and to wash at the end of the dye cycle. The following table gives test data on these two vacuum dyeing runs compared with regular plant dyeings over a three month period of the same color gold.

| | Vacuum Dyeing 200°F | Vacuum Dyeing 210°F | 3 Months Regular Dyeing of Color Gold |
|---|---|---|---|
| Dyed Yarn Strength, Grams | 123.0 | 108.8 | |
| | 129.8 | 121.4 | |
| | 126.4 | 115.1 | 83.0 |
| % Elongation | 11.0 | 8.6 | |
| | 11.1 | 9.9 | |
| | 11.0 | 9.3 | 7.4 |
| Natural Yarn Lot 5012 Yarn Strength, grams | 97.3 | 97.3 | (Other lots) |
| % Elongation | 9.3 | 9.3 | |
| Extractables | | | |
| % Oil Extractable | 3.95 | 3.91 | — |
| % Alcohol Extractable | 1.20 | 1.20 | — |
| % Water Extractable | .04 | .04 | — |
| % Acid Scour | 1.85 | 1.51 | — |
| Total Extractables | 7.04 | 6.65 | |
| *Chemical Tests | | | |
| pH | 4.4 | 4.5 | — |
| Full and Scour | 4.7 | 4.0 | 4.5 |
| Crabbing | 4.5 | 4.3 | 4.4 |
| Sublimation | 5.0 | 5.0 | — |
| Blank Neutral | 2.8 | 2.3 | 2.8 |
| Blank Polyester | 2.8 | 2.3 | 2.6 |
| Acid Perspiration | 4.5 | 4.5 | 4.8 |
| Alkaline Perspiration | 4.0 | 4.0 | 4.6 |
| Dry Cleaning | 5.0 | 5.0 | 4.6 |
| Lightfastness (Break at) | 60 hrs. (very slight) | 60 hrs. (Slight) | 60 hrs. (very slight) |

*It might be noted that the improvement in strength and elongation after dyeing did not adversely affect the other properties of the wool.

Machine Time — 45 minutes vs. 135 minutes for conventional or standard production time.

EXAMPLE NO. 4E

Dyeing of Wool Top with Premetallized Dye — Grey

1. Dye, chemicals, and other ingredients were added to the expansion tank and heated to 150°F.
2. Expansion tank lid was closed and pressurized to 30 p.s.i.
3. Kier evacuated at 26–28 inches mercury.
4. Open expansion tank drain and transfer the entire volume of dye liquor from the tank 16 to tank 10 in 4 seconds. Start pump on inside/out. After 1 minute switch to outside/in.
5. Raise temperature to 200°F.
6. Run 30 minutes — drain.
7. Rinse Results — Uniformity of dyeing was good.

Machine Time — 45 minutes rather than 135 minutes normal production time.

Controlling characteristics which have been found to make it possible to improve dyeing of wool top, 100% wool and polyester/wool blended yarn are essentially the same as those previously noted and include:

1. Removal of air to the lowest practical vacuum (26–28 inches of mercury) in the kier;
2. Heating the dye bath to the highest practical temperature (230°F) before adding to the dye kier; and
3. Forcing the hot dye into the evacuated yarn under a positive pressure — preferably 50–75 p.s.i.

Some of the advantages realized from application of this invention to dyeing wool top, 100% wool and wool/polyester yarns are as follows: (1) No pre-scour is necessary as the lubricating oils can be left on the wool because they do not interfere with dye penetration into an evacuated yarn. (2) Dyestuff auxiliaries and acid can be placed in one bath. (3) Dye is entered into the yarn at dyeing temperature. (4) Excellent levelness throughout the dye package is obtained in dyeing wool and wool blend yarns. (5) Reduction in the time that wool yarn is held at a high temperature minimizes strength loss and reduces yarn shrinkage, improves elongation and reduces felting as compared with normal dyeing. (6) Machine time is reduced from 135 minutes to 45 minutes.

Transfer Times

In some of the above examples, times were given for the rapid transfer of the dye liquor or charge from the expansion tank 16 to the kier or vacuum tank 10. The following is an exemplary table of such information, derived from application of the present invention in different installations:

| Installation No. | Volume Transferred | Time |
|---|---|---|
| 1. | 1,100 gal. | 18 sec. |
| 2. | 800 gal. | 16 sec. |
| 3. | 800 gal. | 16 sec. |
| 4. | 960 gal. | 26 sec. |
| 5. | 960 gal. | 16 sec. |
| 6. | 980 gal. | 45 sec. |
| 7. | 7.5 liters | 4 sec. |

It will thus be seen that the objectives, noted above, have been accomplished.

As will be evident from the foregoing, the time for transfer of the entire charge of treating agent from the expansion tank 16 to the vacuum tank 10 is a different parameter from the time it takes for uniform distribution of the treating agent over the surfaces of the textile material being treated and at the outset of the process. The latter time period is terminated substantially immediately after the textile material is first contacted by the treating agent. The former time period is terminated sometime after that.

The terms "surfaces of the textile material" or "surfaces of the yarn" or the like, as used herein, should be understood to include the surfaces of the fibers comprising the textile material being treated inasmuch as results indicate and it is believed that there is a uniform distribution of the treating agent over all or substantially all of the surfaces of such fibers substantially immediately after the textile material being treated is first contacted by the treating agent.

What is claimed is:

1. In a process for the batch treatment of textile material in the raw, unscoured state with a liquid treating agent, the improvement comprising: placing the textile material to be treated in an enclosed first zone and applying a substantial vacuum to the first zone to produce a greatly reduced subatmospheric pressure therein; providing the fluid treating agent in a second zone and placing the treating agent in said second zone under a positive pressure at least as great as atmospheric pressure; placing the first zone in communication with the second zone through a relatively large diameter conduit; and effecting a very rapid transfer of said treating agent from said second zone through said conduit and into said first zone wherein said treating agent flows through said textile material, said transfer taking place at a flow rate of at least about 500 gallons of said treating agent per minute so that said treating agent is uniformly distributed over the surfaces of said textile material substantially immediately after the textile material is first contacted by said treating agent; and said treating agent including a dyestuff mixed with an alkaline scouring agent whereby the textile material is simultaneously scoured and dyed when treated with said treating agent.

2. The process defined in claim 1 including heating the treating agent to a predetermined temperature while in the second zone and wherein the textile material includes a yarn package in the form of yarn wound on a fluid pervious tube, and further wherein the flow of said treating agent through said textile material is in a controlled direction wherein the treating agent is constrained to flow from the interior of said yarn package outwardly through the yarn.

3. The process defined in claim 2 wherein the pressure in the second zone is 0–75 p.s.i., and wherein the vacuum in said first zone is approximately 26–28 inches of mercury, i.e. about 2–4 inches of mercury absolute pressure.

4. The process defined in claim 3 wherein the treating agent is heated to approximately 160°–220°F. while in said second zone and prior to transfer into said first zone.

5. The process defined in claim 4 wherein the treating agent is subjected to a positive pressure of about 50–75 p.s.i. while in said second zone and prior to transfer into said first zone.

6. The process defined in claim 3 wherein the textile material comprises cellulosic fibers.

7. The process defined in claim 6 wherein the treating agent includes a salt added to the dyestuff and scouring agent.

8. The process defined in claim 6 wherein the dyestuff is a naphthol dye.

9. The process defined in claim 3 wherein the textile material comprises polyester.

10. The process defined in claim 3 wherein the textile material comprises wool.

11. The process defined in claim 2 wherein both the vacuum in the first zone and the positive pressure in said second zone are maintained during the step of transferring the treating agent between the zones.

12. The process defined in claim 2 wherein substantially the entire charge of treating agent in said second zone is transferred through the textile material and into said first zone in a range of about 0–30 seconds after the two zones are placed in communication with each other.

13. The process defined in claim 12 wherein the charge of treating agent is over five hundred gallons.

14. The process defined in claim 12 wherein the charge of treating agent comprises at least about 800 gallons and wherein substantially the entire charge of said treating agent in said second zone is transferred to said first zone in a range of about 0–18 seconds.

15. The process defined in claim 1 wherein the treating agent is recirculated between the second and first zones and through the textile material.

16. The process defined in claim 1 wherein the textile material comprises a blend of polyester and cellulosic fibers.

17. The process defined in claim 1 wherein the textile material comprises polyester.

18. The process defined in claim 1 wherein the textile material comprises textured polyester fibers.

19. In a process for the batch treatment of textile material in the raw unscoured state with a liquid treating agent including a dye liquor, the improvement comprising: placing the textile material to be treated in an enclosed first zone and applying a substantial vacuum in the range of about 2–4 inches of mercury, absolute pressure, to the first zone to produce a greatly reduced subatmospheric pressure therein; providing the liquid treating agent in a second zone and heating it therein, placing the treating agent in said second zone under a positive pressure at least as great as atmospheric pressure; placing the first zone in communication with the second zone through a relatively large diameter conduit; and effecting a very rapid initial transfer of said treating agent from said second zone through said conduit and into said first zone wherein said treating agent flows through said textile material in an inside-out direction, said transfer taking place at a flow rate of at least about 500 gallons of said treating agent per minute so that said treating agent is uniformly distributed over all or substantially all of the surfaces of said textile material substantially immediately after the textile material is first contacted by said treating agent and so that said surface of said textile material are initially exposed to or wetted by the treating agent at uniform or substantially uniform concentration of said dye liquor; and said treating agent also including an inorganic scouring agent whereby the textile material is simultaneously scoured and dyed when treated by said treating agent.

20. The process defined in claim 19 wherein the textile material comprises cellulosic fibers.

21. The process defined in claim 20 wherein the treating agent also includes a salt.

22. The process defined in claim 20 wherein the dyestuff is a naphtol dye.

23. The process defined in claim 19 wherein the textile material comprises polyester.

24. The process defined in claim 19 wherein the textile material comprises wool.

25. The process defined in 19 wherein substantially the entire charge of treating agent in said second zone is transferred through the textile material and into said first zone extremely rapidly and in a range of about 0–30 seconds after the two zones are placed in communication with each other, and further wherein the volume of said entire charge of treating agent is at least about 500 gallons.

26. The process defined in claim 25 wherein the volume of the entire charge of treating agent is over about 900 gallons, and wherein said entire charge is transferred from said second zone into first zone in less than about 20 seconds.

27. The process defined in claim 19 wherein said inorganic scouring agent is an acidic scouring agent.

28. In a process for the batch treatment of cotton, rayon, or synthetic fibers or combinations thereof in the raw unscoured state with a liquid treating agent including a dye liquor, the improvement comprising: placing the textile material to be treated in an enclosed first zone and applying a substantial vacuum in the range of about 2–4 inches of mercury, absolute pressure, to the first zone to produce a greatly reduced subatmospheric pressure therein; providing the liquid treating agent in a second zone and heating it therein, placing the treating agent in said second zone under a positive pressure at least as great as atmospheric pressure; placing the first zone in communication with the second zone through a relatively large diameter conduit; and effecting a very rapid initial transfer of said treating agent from said second zone through said conduit and into said first zone wherein said treating agent flows through said textile material in an inside-out direction, said transfer taking place at a flow rate of at least about 500 gallons of said treating agent per minute so that said treating agent is uniformly distributed over all or substantially all of the surfaces of said textile material substantially immediately after the textile material is first contacted by said treating agent and so that said surfaces of said textile material are initially exposed to or wetted by the treating agent at uniform or substantially uniform concentration of said dye liquor; and said treating agent also including an inorganic scouring agent whereby the textile material is simultaneously scoured and dyed when treated by said treating agent.

* * * * *